US005582514A

United States Patent [19]

Arbogast et al.

[11] Patent Number: 5,582,514

[45] Date of Patent: Dec. 10, 1996

[54] SICKLELESS INTERNAL GEAR PUMP

[75] Inventors: Franz Arbogast; Peter Peiz, both of Heidenheim, Germany

[73] Assignee: J. M. Voith GmbH, Heidenheim, Germany

[21] Appl. No.: 477,678

[22] Filed: Jun. 7, 1995

[30] Foreign Application Priority Data

Jun. 8, 1994 [DE] Germany ..... 44 19 975.9

[51] Int. Cl.[6] ..... F01C 19/06

[52] U.S. Cl. ..... 418/116; 418/79; 418/168; 418/171

[58] Field of Search ..... 418/79, 78, 75, 418/116, 117, 168, 171

[56] References Cited

U.S. PATENT DOCUMENTS

| | | | |
|---|---|---|---|
| 2,866,417 | 12/1958 | Nübling | 418/171 |
| 3,680,989 | 8/1972 | Brundage | 418/79 |
| 5,451,150 | 9/1995 | Arbogast et al. | 418/116 |

FOREIGN PATENT DOCUMENTS

| | | | |
|---|---|---|---|
| 0607497 | 7/1994 | European Pat. Off. . | |
| 4104397 | 9/1991 | Germany . | |
| 4140293 | 6/1993 | Germany . | |
| 5079466 | 3/1993 | Japan | 418/171 |

*Primary Examiner*—Charles G. Freay
*Attorney, Agent, or Firm*—Baker & Daniels

[57] ABSTRACT

A sickleless internal gear pump with an internally toothed ring gear and a pinion meshing with the ring gear, the two fitted rotatably in a common casing. The ring gear includes radial conduits for the medium to be pumped and elements which are radially movably fitted in grooves in the tooth heads of the ring gear or pinion. The sealing elements slide on the opposing tooth head of the pinion or ring gear and include control spaces on which pressure is applied from the rear. For pressure application in the control spaces there is machined at least one control slot in the area of the pressure buildup zone, on at least one side of the part of the casing which laterally bounds the ring gear and pinion.

11 Claims, 3 Drawing Sheets

SICKLELESS INTERNAL GEAR PUMP

BACKGROUND OF THE INVENTION

The present invention relates to a sickleless internal gear pump with sealing elements fitted in the tooth heads and actuated by pressure ducts positioned behind the sealing elements.

Such a pump includes an internally toothed ring gear and a pinion that meshes with the ring gear, the two gears being rotatably received in a common casing wherein the axial width of the casing matches the width of the ring gear and pinion. The casing includes a suction port and a pressure port, and the ring gear includes radial conduits to permit ingress and egress of the fluid medium being pumped. Either of the ring gear or pinion includes a sealing element radially moveable in a profile groove in the tooth head, the sealing element sliding on the opposed tooth head of the other of the pinion or ring gear. The sealing elements include control spaces wherein pressure is applied from the rear.

A pump of this type is disclosed in DE 41 40 293 A1 which is based on DE 41 04 397 A1. U.S. patent application Ser. No. 08/163,033 relates to optimizing the pressure buildup between the opposed tooth heads of the ring gear and pinion wherein there is a rear application of pressure on the sealing elements. This is accomplished by providing in the sealing element a plurality of holes or a lateral groove by way of which part of the working pressure is allowed to act on the sealing element.

This hydraulic relief of the sealing element taught by application Ser. No. 08/163,033 has conceptually, and in practice, the disadvantages that each individual sealing element must include the holes or grooves. The control holes or grooves require mechanical machining which entails relatively high production costs.

The problem underlying the present invention is to provide a simpler, and thus more cost-effective, solution to the rear application of pressure on the radial sealing elements.

SUMMARY OF THE INVENTION

The solution to this problem entails forming at least one control slot on at least one side of the casing which laterally bounds the ring gear and pinion, for the application of pressure on the control spaces in the area of the pressure buildup zone. In other words, the present invention comprises no longer machining the control grooves for relieving the contact force of the radial element in the pressure buildup zone in the radial elements themselves, but to establish them by way of grooves or slots machined in the spatial area of the pressure buildup zone in the casing area adjacent to the rotating ring gear and pinion.

In one embodiment, the axial control slot comprises a plurality of parallel grooves being located such that at the start of pressure buildup they connect the control space of the trailing sealing element to the leading tooth space and connect the control space of the leading sealing element to the trailing tooth space.

Thus, the control space in the ring gear connects via a working area that is greater than the control space width, by two groups of grooves machined in parallel fashion in the casing, connecting respectively with the leading and with the trailing tooth space, without any communicating connection existing between adjacent tooth spaces.

According to a further embodiment, the hydraulic pressure in the control space is controlled by a control slot in the casing that interconnects for a time two tooth spaces and which, due to its cross-sectional shape that is variable across the angle of rotation, enables selective pressure adjustment in the control space.

BRIEF DESCRIPTION OF THE DRAWINGS

The details of the present invention relating to an internal gear pump that is suited for elevated operating pressures, will be more fully explained hereafter with the aid of the drawings, wherein.

DETAILED DESCRIPTION

Figure 1:
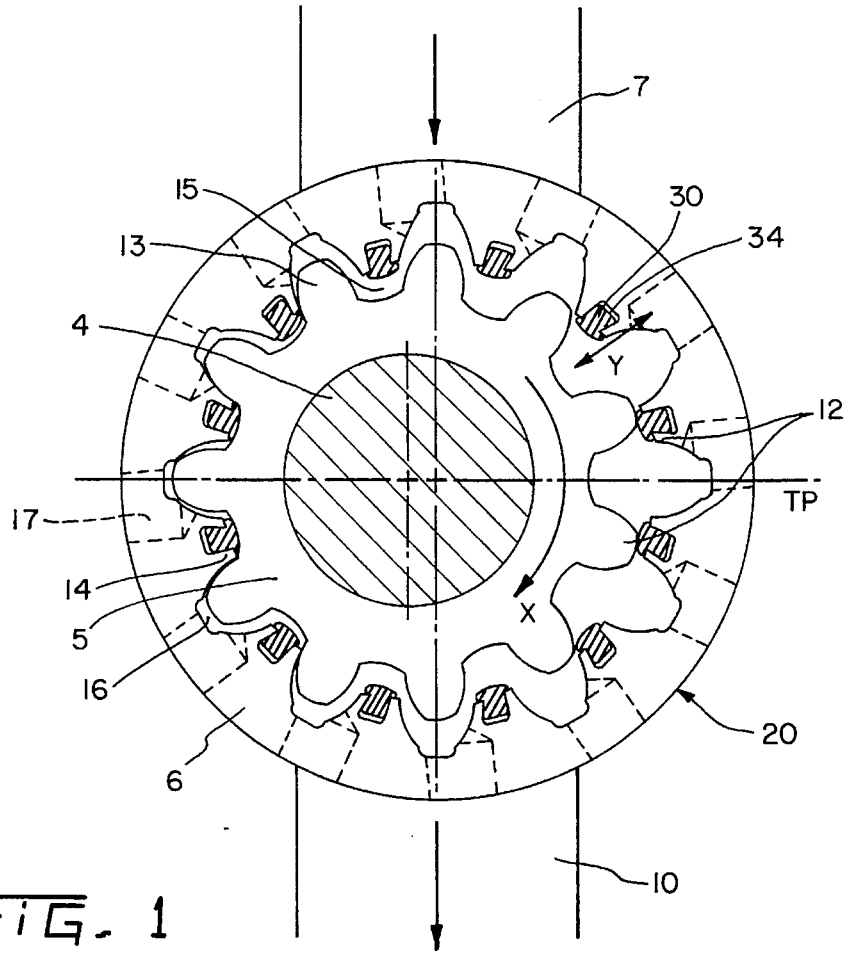
FIG. 1 is a cross section through a sickleless internal gear pump of the present invention in the area of the two gears.

FIG. 1 shows in a cross section a sickleless internal gear pump using a head gasket and involving backlash while sealing always with a tooth flank, including a casing center part and axially spaced further casing parts. Mounted on a pinion shaft 4 an externally toothed pinion 5 meshes with an internally toothed ring gear 6. The toothing 12 of pinion 5 and ring gear 6 has an axial width which is greater than the operating pitch circle diameter of the pinion 5. Pinion 5 and ring gear 6 are not coaxial but eccentric to each other; furthermore, pinion 5 has one tooth fewer than ring gear 6, so that the outside of a tooth head 13 on the pinion 5 always touches the inside of a tooth head 14 on the ring gear 6. A suction port 7 is in the zone in which the teeth on pinion 5 and ring gear 6 disengage while rotating in the direction of arrow X. The suction port 7 in the casing center part, in which the ring gear 6 and pinion 5 are fitted, is in the axial direction toward the adjacent casing part followed by a suction pocket that extends over part of the shell surface 20 of ring gear 6. Originating as well from a pressure pocket extending over a peripheral area on the ring gear 6, a pressure port 10 is located on the opposite end of the pump. The inflow of pressure medium to the interior of the pump, i.e., to the tooth spaces 15, or 16, in the pinion 5 and ring gear 6 that cause the feeding of the pressure medium, takes place through radial conduits or holes 17 in the ring gear 6 (FIGS. 2, 3, 5 and 6). These conduits originate from a shell surface 20 and terminate in the tooth space of the ring gear 6.

The sickleless internal gear pump described so far corresponds to the prior art. According to the illustration of FIG. 1 there are now, by way of example but by no means limiting, radially movable (arrow Y), preferably cross-sectionally mushroom-shaped sealing elements 30 fitted on the tooth heads of ring gear 6, said elements retained in a complementary profile groove 34.

Figure 2:
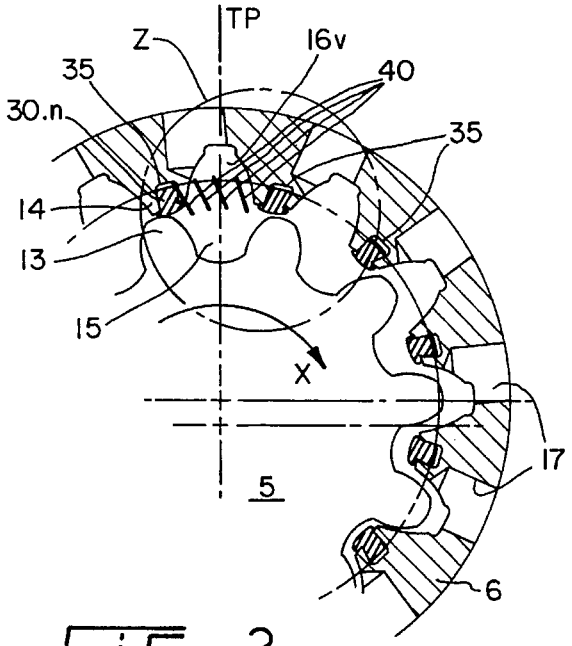
FIG. 2 is a section of the internal gear pump according to FIG. 1 in the area of the pressure buildup zone (after dead center) with control grooves for connecting the leading tooth space to the trailing radial element.
Figure 3:
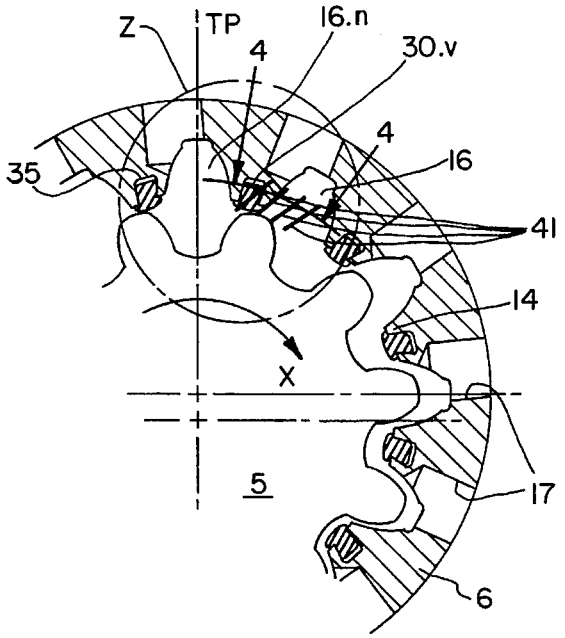
FIG. 3 is a section of the internal gear pump according to FIG. 1 in the area of the pressure buildup zone (after dead center) with control grooves for connecting the leading radial element to the trailing tooth space.

FIG. 2 and FIG. 3 show a section of the internal gear pump illustrated in FIG. 1 and explained above in the area of the pressure buildup zone Z bordering on the so-called dead center TP of the pump. From FIG. 2 and FIG. 3 it is clearly evident how the functional separation of the intake and pressure space of the internal gear pump is taking place by way of the relative motion between ring gear 6 and pinion 5 and by way of sealing elements 30.

The object of the present invention is the actuation of the so-called control spaces 35 of sealing elements 30, that is, of the rear clearance between the underside of sealing elements 30 and the bottom of profile grooves 34. This actuation occurs by way of grooves machined or otherwise formed in casing 19 (FIG. 4) which laterally bound the toothed parts (ring gear 6 and pinion 5). A plurality of grooves 40 are machined or otherwise formed (FIG. 2) in the area of dead center TP obliquely with a negative angle of repose and by way of a second plurality of grooves 41 machined or otherwise formed (FIG. 3), viewed in the direction of rotation X, obliquely behind the dead center position TP with a positive angle of repose.

Viewed functionally (refer to FIG. 2), the control space 35 of the sealing element 30.n is trailing in the direction of rotation X and is connected to the leading tooth space 16.v, while at the same time (refer to FIG. 3) the control space 35 of the leading sealing element 30.v is connected with the trailing tooth space 16.n. For the sake of clarity it is noted once again that grooves 40 illustrated in FIG. 2 and grooves 41 shown in FIG. 3 are provided jointly, so that a truly optimal pressure buildup occurs after dead center TP.

As regards FIGS. 2 and 3, it should be noted that grooves 40, or 41, do not create a communicating connection between the tooth spaces. But with the pressure angle, or angle of rotation, for the control space 35 being greater than would correspond to the tooth width, the optimum actuation occurs through several (four in FIGS. 2, 3 and 4) mutually parallel grooves 40, or 41. As regards their mutual spacing, these grooves have dimensions such that the groove following in the direction of rotation X always assumes the control shortly before the emergence of the relevant leading groove. Therefore, always the same pressure as in the actuated tooth space prevails in the control space 35 of the sealing element 30 traversing the dead center position TP.

Figure 4:
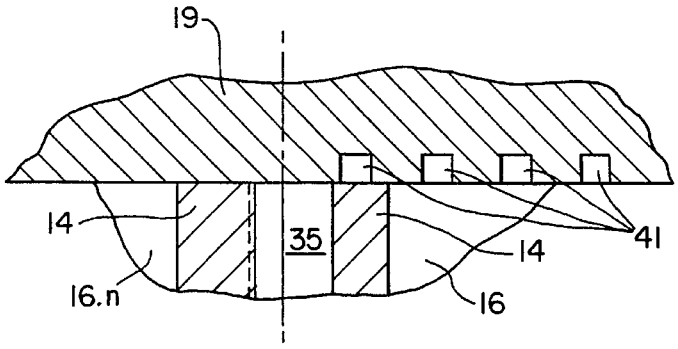
FIG. 4 is a sectional view along line A-B of FIG. 3.

FIG. 4 is a sectional illustration along line A—B in FIG. 3, showing the arrangement of grooves 41 in the casing 19 and their shape as, e.g., a rectangular recess. As illustrated with the aid of FIG. 3, a communicating connection is successively opened via grooves 41 between control space 45 of the leading sealing element (30.v in FIG. 3) and the trailing tooth space 16.n.

Figure 5:
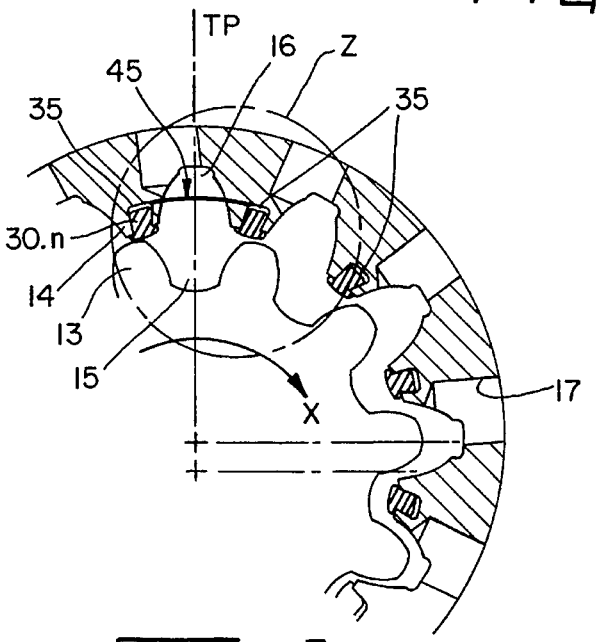
FIG. 5 is a section of the internal gear pump in the area of the pressure buildup zone (after dead center) with a control slot in its working position by which the control space and the leading tooth space are connected.
Figure 6:
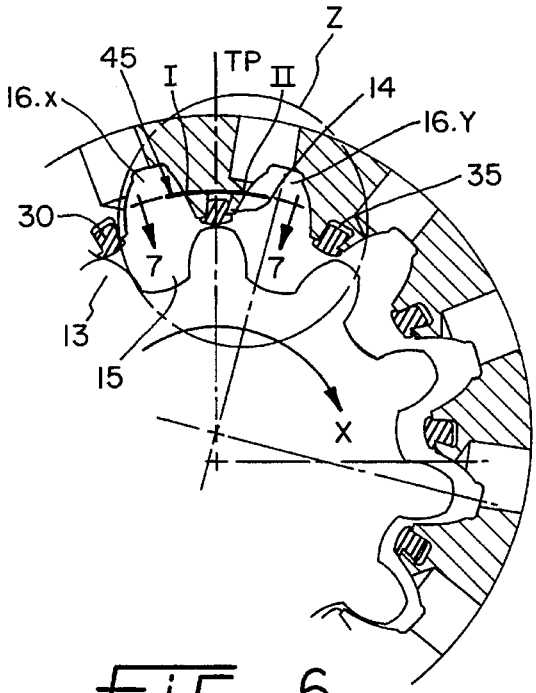
FIG. 6 is a section of the internal gear pump in the area of the pressure buildup zone (after dead center) with a control slot in the working position in which two tooth spaces are interconnected.

FIGS. 5 and 6 (similar to FIGS. 2 and 3) illustrate a further embodiment and show a section of the internal gear pump illustrated in FIG. 1, in the area of the pressure buildup zone (Z) following dead center TP. Evident in FIGS. 5 and 6 is the control slot 45 machined in the area of dead center TP in the casing 19 (FIG. 7) bordering on the toothed components of ring gear 6 and pinion 5. Control slot 45 is situated on the diameter of the control spaces 35 of sealing elements 30 and serves the following functions:

at the start of pressure buildup (refer to FIG. 5) the control space 35 of the trailing sealing element 30.n is connected to the leading tooth space 16.

when the tooth head 14 of ring gear 6 is then situated (refer to FIG. 6) above the control slot 45, due to the rotation in the direction X, a pressure gradient prevails between the tooth spaces 15 and 16.y, since a greater working pressure prevails in the leading tooth space, whereas the trailing tooth space is pressureless. The pressure in the control space 35 of the sealing element adjusts then in accordance with the percentage overlap of the surface areas of control slot 45.

Viewed in the peripheral direction, control slot 45 may extend curvilinearly as illustrated or straight. As regards its cross-sectional form, control slot 45 is variable in its design, so that the partial pressure that is active in the control space 35 can be optimized by way of the cross sections (refer to I and II in FIG. 7) that are effective depending on angular position.

Figure 7:
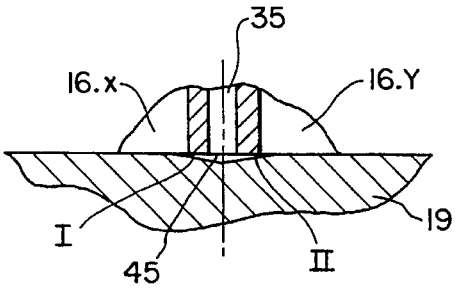
FIG. 7 is a sectional view along line C—D in FIG. 6.

The above geometric conditions are further illustrated in enlarged FIG. 7, taken along section line C—D in FIG. 6. Control slot 45 in casing 19 connects the adjacent tooth spaces 16.x and 16.y, initiating in the control space 35 of the conjugate sealing element 30 a partial pressure corresponding to the cross sectional areas I and II.

Figure 8A:
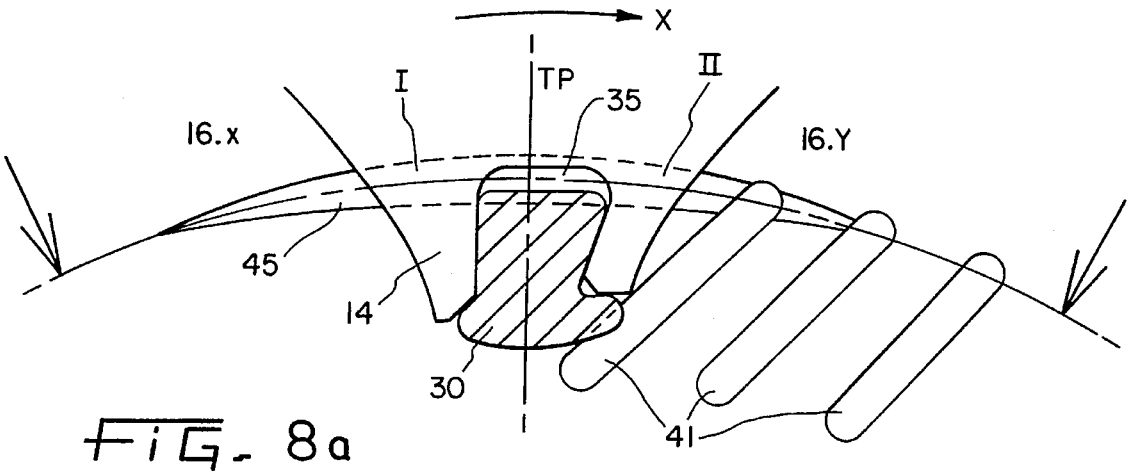
FIGS. 8*a* and 8*b* are sections of the internal gear pump of FIG. 4 and FIG. 7, with control slots for connecting the leading radial element to the trailing tooth space, and with a control slot in the position in which the control space and the leading tooth space are connected.
Figure 8B:
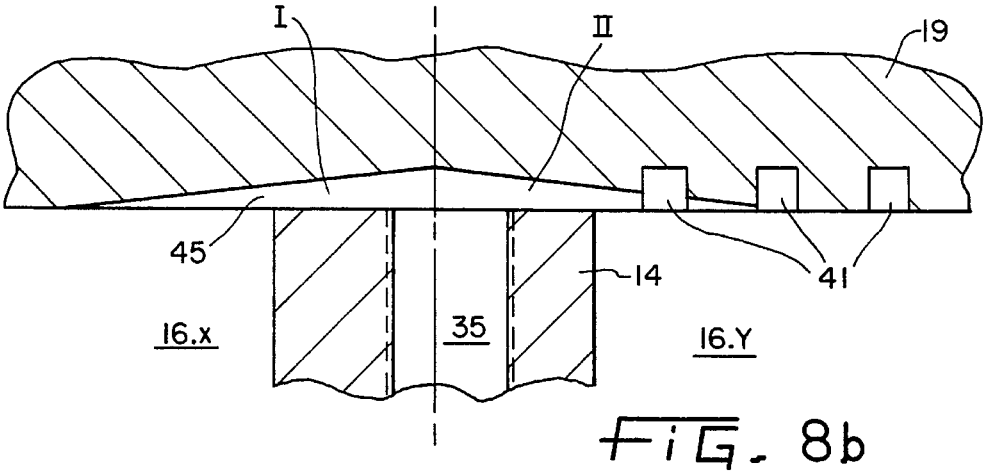
Figure 9:
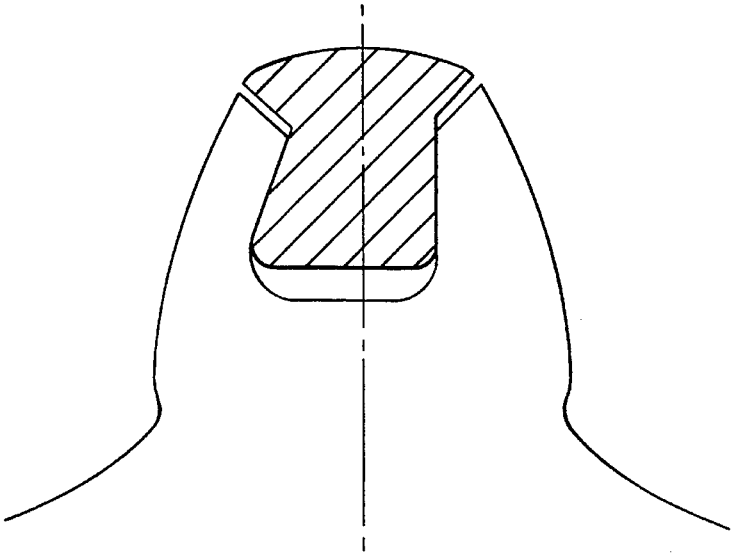
FIG. 9 is a fragmentary plan view of a pinion showing a sealing element contained within a pinion tooth head.

The configurations illustrated in FIGS. 2, 3 and 4, and FIGS. 5, 6 and 7 are each suited to solve the problem underlying the present invention. As a further development of the present invention it is also possible though to combine grooves 41 shown in FIGS. 3 and 4 and the control slot 45 according to FIGS. 6 and 7. This configuration is illustrated in FIGS. 8*a* and 8*b*, partly in section.

The control space 35 fashioned in the tooth head 14 of ring gear 6 at the bottom of sealing element 30 is pressurized here by way of a control slot 45 machined in the peripheral direction, analogous to the embodiment described in FIGS. 5, 6 and 7 and control space 35 is connected also by three, for example, grooves 41 with the trailing tooth space 16.n. The latter grooves 41 have a rectangular cross-sectional shape, for example. The control slot 45 is machined curvilinearly along the peripheral line of the control space 35 while fashioned across its overall length as a conic flute that extends acutely on both ends. The configuration illustrated in FIG. 8 allows an optimal control of the pressure buildup in the internal gear pump after the dead center position TP.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

We claim:

1. A sickleless internal gear pump comprising:

a casing having a suction port and a pressure port;

an internally toothed ring gear including a plurality of tooth heads and being rotatably received in said casing, said ring gear including a plurality of radial conduits for a fluid medium to be pumped;

a pinion having a plurality of tooth heads opposing said ring gear tooth heads, said pinion being rotatably received in said casing and being disposed inside said ring gear;

the tooth heads of one of said ring gear and pinion each including a profile groove and a radially moveable sealing element received in a said groove, said sealing elements sliding on the opposing tooth heads of the other of said ring gear and pinion, each of said profile grooves defining a control space behind the respective sealing element for applying pressure to the sealing element in a radial direction;

said pump having a pressure buildup zone located intermediate said suction port and said pressure port; and at least one control slot formed in said casing in the area of said pressure buildup zone, said control slot formed in a surface of said casing that laterally bounds a side of the tooth heads of said ring gear and a side of the tooth heads of said pinion.

2. The gear pump of claim 1 wherein said at least one control slot comprises a plurality of generally parallel grooves formed in said casing surface, said grooves being fashioned such that at the start of pressure buildup between said ring gear and pinion in said zone, said grooves connect the control space of a trailing sealing element in said zone with a leading tooth space in said zone and further connect the control space of a leading sealing element in said zone with a trailing tooth space in said zone.

3. The gear pump of claim 2 wherein there are four said grooves.

4. The gear pump of claim 3 wherein said grooves are generally rectangular in cross section.

5. The gear pump of claim 2 wherein said grooves are generally rectangular in cross section.

6. The gear pump of claim 1 including a second control slot formed in said casing in the area of the pressure buildup zone, said second control slot formed in a second surface of said casing that laterally bounds a side of the tooth heads of said ring gear and pinion opposite said side bounded by said first mentioned control slot.

7. The gear pump of claim 1 wherein said plurality of ring gear tooth heads are individually separated by a plurality of ring gear tooth spaces, said plurality of pinion tooth heads are individually separated by a plurality of pinion tooth spaces, any two rotationally consecutive ring gear tooth spaces define adjacent tooth spaces, any two rotationally consecutive pinion tooth spaces define adjacent tooth spaces, said adjacent tooth spaces include a leading tooth space and a trailing tooth space, and said control slot is fashioned such that at the start of pressure buildup in said zone said slot connects the control space of a trailing sealing element in said zone with a leading tooth space and thereafter connects two adjacent tooth spaces in said zone with each other.

8. The gear pump of claim 7 wherein said control slot has a cross section that is variable in the direction of rotation of said ring gear and pinion.

9. The gear pump of claim 7 wherein said control slot has a cross section that is constant in the direction of rotation of said ring gear and pinion.

10. The gear pump of claim 7 wherein said control slot is curvilinear in a peripheral direction.

11. The gear pump of claim 7 wherein said control slot, when viewed in a peripheral direction, extends in a straight line.

* * * * *